US006554072B1

(12) United States Patent
Mournian et al.

(10) Patent No.: US 6,554,072 B1
(45) **Date of Patent: *Apr. 29, 2003**

(54) CO-LINEAR TENSIONER AND METHODS FOR ASSEMBLING PRODUCTION AND DRILLING RISERS USING SAME

(75) Inventors: Timothy I. Mournian, Long Beach, CA (US); Graeme E. Reynolds, Houston, TX (US)

(73) Assignee: Control Flow Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/000,393

(22) Filed: Nov. 30, 2001

Related U.S. Application Data

(63) Continuation-in-part of application No. 09/881,139, filed on Jun. 14, 2001.
(60) Provisional application No. 60/211,652, filed on Jun. 15, 2000.

(51) Int. Cl.[7] ..... E21B 29/12; E21B 41/04
(52) U.S. Cl. ..... 166/355; 166/346; 166/367; 405/224.2; 405/224.4
(58) Field of Search ..... 166/350, 359, 166/367, 355, 346; 405/224.4, 224.2

(56) References Cited

U.S. PATENT DOCUMENTS

| | | | | | |
|---|---|---|---|---|---|
| 3,280,908 | A | * | 10/1966 | Todd | 166/340 |
| 3,313,345 | A | * | 4/1967 | Fischer | 166/355 |
| 3,643,751 | A | | 2/1972 | Crickmer | |
| 3,955,621 | A | * | 5/1976 | Webb | 166/355 |
| 4,068,868 | A | | 1/1978 | Ohrt | |
| 4,215,950 | A | * | 8/1980 | Stevenson | 114/264 |
| 4,317,586 | A | * | 3/1982 | Campbell | 285/145.4 |
| 4,367,981 | A | * | 1/1983 | Shapiro | 166/355 |
| 4,379,657 | A | * | 4/1983 | Widiner et al. | 405/168.4 |
| 4,615,542 | A | | 10/1986 | Ideno et al. | |
| 4,712,620 | A | | 12/1987 | Lim et al. | |
| 4,787,778 | A | * | 11/1988 | Myers et al. | 166/367 |
| 4,808,035 | A | * | 2/1989 | Stanton et al. | 166/355 |
| 4,883,387 | A | * | 11/1989 | Myers et al. | 166/367 |
| 5,727,630 | A | | 3/1998 | Brammer | |
| 5,846,028 | A | | 12/1998 | Thory | |
| 5,951,061 | A | | 9/1999 | Arlt, III et al. | |
| 6,419,277 | B1 | * | 7/2002 | Reynolds | 166/367 |

FOREIGN PATENT DOCUMENTS

| | | |
|---|---|---|
| GB | 2141470 A | 12/1984 |
| WO | WO 97/43516 | 11/1997 |
| WO | WO 00/24998 | 5/2000 |

* cited by examiner

*Primary Examiner*—Robert E. Pezzuto
*Assistant Examiner*—Thomas A. Beach
(74) *Attorney, Agent, or Firm*—Anthony F. Matheny; Andrews & Kurth L.L.P.

(57) ABSTRACT

A tensioner for providing a conduit, e.g., drilling and production riser strings, from a floating vessel at the surface of the ocean to the blowout preventer stack, production tree, or other assembly which is connected to the wellhead at the sea floor. The tensioner compensates for vessel motion induced by wave action and heave and maintains a variable tension to the riser string alleviating the potential for compression and thus buckling or failure of the riser string. The tensioner of the present invention preferably includes at least one mandrel having at least one hang-off donut; at least one upper flexjoint swivel assembly, at least one radially ported manifold, and at least one tensioning cylinder co-linearly combined in a single unit. Methods for assembling risers are also disclosed.

47 Claims, 7 Drawing Sheets

CO-LINEAR TENSIONER AND METHODS FOR ASSEMBLING PRODUCTION AND DRILLING RISERS USING SAME

RELATED APPLICATION

This application is a continuation-in-part of U.S. patent application Ser. No. 09/881,139 filed Jun. 14, 2001 and entitled Tensioner/Slip-Joint Assembly which claims the benefit of U.S. Provisional Patent Application Serial No. 60/211,652, filed Jun. 15, 2000.

BACKGROUND OF THE INVENTION

1. Field of the Invention

The invention relates to offshore drilling and production operations and is specifically directed to drilling and production tensioners and risers assembled using the tensioners.

2. Description of Related Art

A marine riser system is employed to provide a conduit from a floating vessel at the water surface to the blowout preventer stack or, production tree, which is connected to the wellhead at the sea floor. A tensioning system is utilized to maintain a variable tension to the riser string alleviating the potential for compression and in turn buckling or failure.

Historically, conventional riser tensioner systems have consisted of both single and dual cylinder assemblies with a fixed cable sheave at one end of the cylinder and a movable cable sheave attached to the rod end of the cylinder. The assembly is then mounted in a position on the vessel to allow convenient routing of wire rope which is connected to a point at the fixed end and strung over the movable sheaves. A hydro/pneumatic system consisting of high pressure air over hydraulic fluid applied to the cylinder forces the rod and in turn the rod end sheave to stroke out thereby tensioning the wire rope and in turn the riser.

The number of tensioner units employed is based on the tension necessary to maintain support of the riser and a percentage of overpull which is dictated by met-ocean conditions i.e., current and operational parameters including variable mud weight, etc.

Normal operation of these conventional type tensioning systems have required high maintenance due to the constant motion producing wear and degradation of the wire rope members. Replacing the active working sections of the wire rope by slipping and cutting raises safety concerns for personnel and has not proven cost effective. In addition, available space for installation and, the structure necessary to support the units including weight and loads imposed, particularly in deep water applications where the tension necessary requires additional tensioners poses difficult problems for system configurations for both new vessel designs and upgrading existing vessel designs.

Recent deepwater development commitments have created a need for new generation drilling vessels and production facilities requiring a plethora of new technologies and systems to operate effectively in deep water and alien/harsh environments. These new technologies include riser tensioner development where direct acting cylinders are utilized.

Current systems as manufactured by Hydralift employ individual cylinders arranged to connect one end to the underside of the vessel sub-structure and one end to the riser string. These direct acting cylinders are equipped with ball joint assemblies in both the rod end and cylinder end to compensate for riser angle and vessel offset. Although this arrangement is an improvement over conventional wire rope systems, there are both operational and configuration problems associated with the application and vessel interface. For example, one problem is the occurrence of rod and seal failure due to the bending induced by unequal and non-linear loading caused by vessel roll and pitch. Additionally, these systems cannot slide off of the wellbore centerline to allow access to the well. For example, the crew on the oil drilling vessel is not able to access equipment on the seabed floor without having to remove and breakdown the riser string.

The tensioner system of the present invention is an improvement over existing conventional and direct acting tensioning systems. Beyond the normal operational application to provide a means to apply variable tension to the riser, the system provides a number of enhancements and options including vessel configuration and its operational criteria.

The tensioner system has a direct and positive impact on vessel application and operating parameters by extending the depth of the water in which the system may be used and operational capability. In particular, the system is adaptable to existing medium class vessels considered for upgrade by reducing the structure, space, top side weight and complexity in wire rope routing and maintenance, while at the same time increasing the number of operations which can be performed by a given vessel equipped with the tensioner system.

Additionally, the present invention extends operational capabilities to deeper waters than conventional tensioners by permitting increased tension while reducing the size and height of the vessel structure, reducing the amount of deck space required for the tensioner system, reducing the topside weight, and increasing the oil drilling vessel's stability by lowering its center of gravity.

Moreover, the tensioner of the present invention is co-linearly symmetrical with tensioning cylinders. Therefore, the present tensioner eliminates offset and the resulting unequal loading that causes rapid rod and seal failure in some previous systems.

The tensioner of the present invention is also radially arranged and may be affixed to the vessel at a single point. Therefore, the tensioner may be conveniently installed or removed as a single unit through a rotary table opening, or disconnected and moved horizontally while still under the vessel.

The tensioner of the present invention further offers operational advantages over conventional methodologies by providing options in riser management and current well construction techniques. Applications of the basic module design are not limited to drilling risers and floating drilling vessels. The system further provides cost and operational effective solutions in well servicing/workover, intervention and production riser applications. These applications include all floating production facilities including, tension leg platform (T.L.P.) floating production facility (F.P.F.) and production spar variants. The system when installed provides an effective solution to tensioning requirements and operating parameters including improving safety by eliminating the need for personnel to slip and cut tensioner wires with the riser suspended in the vessel moonpool. An integral control and data acquisition system provides operating parameters to a central processor system which provides supervisory control.

The present invention is also directed to a method of assembling a string of production riser, or production riser, for drill stem testing while the larger string of drilling riser, referred to herein as the drilling riser, is still suspended from the vessel, and preferably, still connected to the wellhead. Therefore, the amount of time, and thus money, required to prepare for the drill stem test is substantially reduced. While the background of method of assembling a production riser will be discussed in greater detail, it is to be understood that the methods of the present invention include assembling a drilling riser.

Generally, a well is first drilled from a drilling vessel or drilling platform having one or more derricks for supporting the drilling riser and other drilling equipment. After drilling is completed, the well is "closed off" using valves or other equipment. The drilling riser is then disassembled. The production riser is then assembled, usually utilizing the same derrick and equipment. This is especially true in vessels having only one fill size derrick that can support the weight of the riser. Both the drilling riser and the production riser consist of tubulars, e.g., casing, attached end to end and extended from the wellhead to the drilling or production facility, e.g., vessel or platform.

Alternatively, in drilling vessels having two derricks, the second derrick may be utilized to assemble the production riser. After the production riser is assembled, it is attached to the wellhead and a drill stem test is performed. The drill stem test is an evaluation of unrestricted flow of hydrocarbon, e.g., oil or gas, from the well and into shipboard tanks to facilitate determining the hydrocarbon reservoir's size and propensity to flow, e.g., the pressure differential between the well and the tanks capturing the flowing hydrocarbon.

Present methods and applications of this process require either two derricks on the drilling or production vessel or platform, or, require substantially amounts of time, and thus money, to detach and disassemble the drilling riser from the wellhead, and then assemble and attach the production riser to the wellhead using a single derrick.

The methods of the present invention overcome this problem because a derrick is not required to assemble the riser. Instead, a crane,jack knife hoisting rig, or other lifting device smaller than a full size derrick may be used. Additionally, the methods of the present invention provide the advantages of: providing a means to run the riser from the unused rig floor aboard a drilling or production facility, without the use of a standard capacity derrick; includes a system that is modular in construction, transportation, and assembly; providing interchangeability with other drilling or production facilities; permitting assembly of the production riser while the drilling riser is still in use and vice versa; reducing the amount of time that the wellhead is "idle," i.e., that either a drilling riser or production riser is in use; reducing the amount of extra equipment that is needed by the facility in making the rig floor ready for use; providing sufficient tension to the long string of the riser in deepwater over extended periods of time; providing a means to maintain the riser in constant tension, with, if necessary, overpull, while the riser is in service; providing the capability to accommodate angular offset between the riser and the vessel induced by vessel motion; and providing the capability to accommodate axial torque induced in the riser string in the event the drilling or production vessel rotates around the wellhead due to weather and sea conditions.

Further, the methods of assembling a riser using the tensioner of the present invention permit the assembly of the production riser without having to disconnect, or disassemble the drilling riser from the wellhead, and vice versa. Therefore, the drilling tubulars and riser can subsequently be disconnected from the wellhead and the vessel moved to position the pre-assembled production riser into to place and secured to the wellhead, and vice versa, thereby resulting in time, and thus, cost savings.

SUMMARY OF INVENTION

The foregoing advantages have been obtained through the present tensioner comprising: at least one mandrel; at least one upper flexjoint swivel assembly in communication with the at least one mandrel; at least one manifold in communication with the at least one upper flexjoint swivel assembly, the at least one manifold having a first radial fluid band and a second radial fluid band; at least one tensioning cylinder having a blind end, a rod end, and at least one transfer tubing, the blind end being in communication with the first radial fluid band, the transfer tubing being in communication with the second radial fluid band and the rod end being in communication with at least one flexjoint bearing; and a base in communication with the at least one flexjoint bearing.

A further feature of the tensioner is that the manifold may include a third radial fluid band, the third radial fluid band being in communication with either the blind end or the at least one transfer tubing. Another feature of the tensioner is that the first and third radial fluid bands may be in communication with the at least one transfer tubing and the second radial fluid band may be in communication with the blind end of the at least one tensioning cylinder. An additional feature of the tensioner is that the tensioner may include six tensioning cylinders, wherein at least one tensioning cylinder may be in communication with a first control source and at least one tensioning cylinder may be in communication with a second control source. Still another feature of the tensioner is that the first control source and second control source may be in communication with the same tensioning cylinder. A further feature of the tensioner is that the tensioner may include a hang-off donut. Another feature of the tensioner is that the hang-off donut may be disposed on the mandrel or along the tensioning cylinders, e.g., below the blind end of the tensioning cylinders which captures each of the tensioning cylinders and allows for the transference of axial tension load from the cylinder casing to the mandrel and then directly to the rig structure. An additional feature of the tensioner is that the blind end may be connected to the manifold by at least one sub seal. Still another feature of the tensioner is that each of the at least one tensioning cylinder may include at least one cylinder head. Yet another feature of the tensioner is that the first, second, and third radial fluid bands may each be in communication with a transducer. A further feature of the tensioner is that the tensioner may include at least two tensioning cylinders. Another feature of the tensioner is that the tensioner may include two radial fluid bands in communication with at least one transfer tubing and one radial fluid band in communication with the blind end of each of the at least one tensioning cylinder. An additional feature of the tensioner is that a sub-manifold may be included between the blind end of the tensioning cylinder and the manifold, thereby permitting remotely operated valves to be disposed in the communication channels between the tensioning cylinders and the manifold making it possible to isolate any single or combination of tensioning cylinders for operation, maintenance and Riser Disconnect Management Systems (RDMS) procedures. Still another feature of the tensioner is that a swivel feature may be incorporated either within or in the area of the manifold or upper flexjoint swivel assembly, thereby providing a means to remotely turn the entire tensioner to remove torsional stresses in the riser string that result from the vessel changing heading. A further feature of the tensioner is that the tensioner may further comprise at least one lower flexjoint swivel assembly in communication with the at least one tensioning cylinder and the base.

The foregoing advantages have also been achieved through the present tensioner comprising: at least one mandrel having a first mandrel end and a second mandrel end; at least one upper flexjoint swivel assembly having a first upper flexjoint swivel assembly end and a second upper flexjoint swivel assembly end; at least one manifold having a first manifold surface and a second manifold surface; at least one tensioning cylinder having a blind end, a rod end, and at least one flexjoint bearing in communication with the rod end; and a base, wherein the second mandrel end is connected to the first upper flexjoint swivel assembly end, the second upper flexjoint swivel assembly end is connected to the first manifold surface, the second manifold surface is connected to the blind end, and the rod end and the at least one flexjoint bearing are connected to the base.

A further feature of the tensioner is that tensioner may further include at least one lower flexjoint swivel assembly having a first lower flexjoint swivel assembly end and a second lower flexjoint swivel assembly end, wherein the rod end is connected to the first lower flexjoint swivel assembly end and the second lower flexjoint swivel assembly end is connected to the base. A further feature of the tensioner is that the at least one tensioning cylinder may include at least one transfer tubing, the at least one transfer tubing being in communication with the manifold. Another feature of the tensioner is that the manifold may include two radial fluid bands in communication with the at least one transfer tubing and one radial fluid band in communication with the blind end of the at least one tensioning cylinder. An additional feature of the tensioner is that the tensioner may include six tensioning cylinders, wherein at least one of the tensioning cylinders is in communication with a first control source and at least one tensioning cylinder is in communication with a second control source. Still another feature of the tensioner is that the first control source and the second control source may be in communication with the same tensioning cylinder. A further feature of the tensioner is that the tensioner may include a hang-off donut. Another feature of the tensioner is that the at least one manifold may include at least two radial fluid bands. An additional feature of the tensioner is that at least one of the at least two radial fluid bands may be in communication with the blind end and at least one of the at least two radial fluid bands may be in communication with the rod end.

The foregoing advantages have also been achieved through the present tensioner comprising: at least one mandrel, at least one upper flexjoint swivel assembly, at least one manifold, at least one tensioning cylinder, and a base, the at least one tensioning cylinder includes a blind end in communication with the at least one manifold and a rod end in communication with the base; wherein the at least one mandrel, the at least one upper flexjoint swivel assembly, the at least one manifold, the at least one tensioning cylinder, and the base are assembled to form a unitary, co-linear tensioner.

A further feature of the tensioner is that the tensioner may further comprise at least one lower flexjoint swivel assembly. An additional feature of the tensioner is that the at least one mandrel may be connected to the at least one upper flexjoint swivel assembly, the at least one upper flexjoint swivel assembly being connected to the at least one manifold, the at least one manifold being connected to the at least one tensioning cylinder, the at least one tensioning cylinder being connected to the at least one lower flexjoint swivel assembly, and the at least one lower flexjoint swivel assembly being connected to the base.

The foregoing advantages have also been achieved through the present method for assembling a riser having a plurality of tubulars comprising the steps of: (a) providing a tensioner having a first tensioner end, a second tensioner end, a retracted position, an extended position, at least one mandrel, at least one upper flexjoint swivel assembly in communication with the at least one mandrel, at least one manifold in communication with the at least one upper flexjoint swivel assembly, the at least one manifold having a first radial fluid band and a second radial fluid band, at least one tensioning cylinder having a blind end, a rod end, and at least one transfer tubing, the blind end being in communication with the first radial fluid band, the transfer tubing being in communication with the second radial fluid band, and a base in communication with the rod end of each of the at least one tensioning cylinder; (b) providing a drilling or production facility having a rig floor and a moonpool disposed below the rig floor, the rig floor including at least one rig floor slip having a rig floor slip opened position and a rig floor slip closed position; (c) inserting the tensioner through the at least one rig floor slip, through the rig floor, and into the moonpool; (d) connecting the tensioner to the rig floor; (e) inserting a first tubular through the at least one rig floor slip, through the rig floor, through the tensioner, and into the moonpool; (f) disposing the at least one rig floor slip around the first tubular and moving the at least one rig floor slip from the rig floor slip opened position to the rig floor slip closed position, whereby the first tubular is maintained in place by the at least one rig floor slip; (g) connecting a second tubular to the first tubular thereby forming a riser having a plurality of tubulars; (h) moving the at least one rig floor slip from the rig floor closed position to the rig floor opened position; (i) inserting the second tubular through the at least one rig floor slip, through the rig floor, through the tensioner, and into the moonpool; (j) moving the at least one rig floor slip from the rig floor slip opened position to the rig floor slip closed position, whereby the riser is maintained in place by the at least one rig floor slip; (k) releasably securing the base of the tensioner to the first tubular; (l) connecting a third tubular to the second tubular; (m) moving the at least one rig floor slip from the rig floor closed position to the rig floor opened position; (n) inserting the third tubular through the at least one rig floor slip, through the rig floor, through the tensioner, and into the moonpool, thereby moving the tensioner from the retracted position to the extended position; (o) moving the at least one rig floor slip from the rig floor slip opened position to the rig floor slip closed position; (p) releasing the base of the tensioner from the first tubular, whereby the riser is maintained in place by the at least one rig floor slip; (q) moving the tensioner from the extended position to the retracted position; (r) releasably securing the base of the tensioner to the second tubular; (s) connecting a fourth tubular to the third tubular; (t) moving the at least one rig floor slip from the rig floor closed position to the rig floor opened position; (u) inserting the fourth tubular through the at least one rig floor slip, through the rig floor, through the tensioner, and into the moonpool, thereby moving the tensioner from the retracted position to the extended position; (v) moving the at least one rig floor slip from the rig floor slip opened position to the rig floor slip closed position; (w) releasing the base of the tensioner from the second tubular, whereby the riser is maintained in place by the at least one rig floor slip; (x) moving the tensioner from the extended position to the retracted position; and (y) releasably securing the base of the tensioner to the third tubular.

A further feature of the method for assembling a riser having a plurality of tubulars is that steps (s) through (y) may be repeated with at least one additional tubular until the riser has a predetermined length. Another feature of the method for assembling a riser having a plurality of tubulars is that the method may further include the steps of: connecting a final tubular to the riser; and inserting the final tubular through the at least one rig floor slip, through the rig floor and the tensioner, and into the moonpool. An additional feature of the method for assembling a riser having a plurality of tubulars is that the tensioner may be moved from the extended position to the retracted position, by activating at least one control source in communication with the tensioner. Still another feature of the method for assembling a riser having a plurality of tubulars is that the tensioner and each of the plurality of tubulars may be inserted through the rig floor and into the moonpool by lifting and positioning the tensioner and each of the plurality of tubulars with a crane. A further feature of the method for assembling a riser having a plurality of tubulars is that the tensioner and each of the plurality of tubulars may be inserted through the rig floor and into the moonpool by lifting and positioning the tensioner and each of the plurality of tubulars with a jack knife hoisting rig. Another feature of the method for assembling a riser having a plurality of tubulars is that the tensioner may be connected to the rig floor by removing the at least one rig floor slip and resting the tensioner on the rig floor. An additional feature of the method for assembling a riser having a plurality of tubulars is that the tensioner may be connected to the rig floor by placing the tensioner in communication with a rotating bearing disposed on the rig floor. Still another feature of the method for assembling a riser having a plurality of tubulars is that at least one spider beam may be inserted and at least one subsea appliance is disposed on the at least one spider beam and connected to the first tubular prior to the connection of the second tubular to the first tubular. A further feature of the method for assembling a riser having a plurality of tubulars is that the at least one spider beam may be removed after the connection of the at least one subsea appliance is connected to the first tubular.

The foregoing advantages have also be achieved through the present method for assembling a riser having a plurality of tubulars comprising the steps of: (a) providing a tensioner having a first tensioner end, a second tensioner end, a retracted position, an extended position, at least one mandrel, at least one upper flexjoint swivel assembly in communication with the at least one mandrel, at least one manifold in communication with the at least one upper flexjoint swivel assembly, the at least one manifold having a first radial fluid band and a second radial fluid band, at least one tensioning cylinder having a blind end, a rod end, and at least one transfer tubing, the blind end being in communication with the first radial fluid band, the transfer tubing being in communication with the second radial fluid band, and a base in communication with the rod end of each of the at least one tensioning cylinder; (b) providing a drilling or production facility having a rig floor and a moonpool disposed below the rig floor, the rig floor having at least one rig floor slip having a rig floor slip opened position and a rig floor slip closed position; (c) inserting a first tubular through the at least one rig floor slip, through the rig floor, and into the moonpool; (d) moving the at least one rig floor slip from the rig floor slip opened position to the rig floor slip closed position, whereby the first tubular is maintained in place by the at least one rig floor slip; (e) connecting a second tubular to the first tubular thereby forming a riser having a plurality of tubulars; (f) moving the at least one rig floor slip from the rig floor closed position to the rig floor opened position; (g) inserting the second tubular through the at least one rig floor slip, through the rig floor, and into the moonpool; (h) moving the at least one rig floor slip from the rig floor slip opened position to the rig floor slip closed position, whereby the riser is maintained in place by the at least one rig floor slip; (i) providing at least one spider beam, the at least one spider beam having at least one spider beam slip having a spider beam slip opened position and a spider beam slip closed position; (j) disposing the at least one spider beam slip around the riser and moving the at least one spider beam slip from the spider beam slip opened position to the spider beam slip closed position; (k) moving the at least one rig floor slip from the rig floor slip closed position to the rig floor slip opened position, whereby the riser is maintained in place by the at least one spider beam slip; (l) lowering the tensioner over the riser, through the rig floor, and into the moonpool, whereby the riser passes through the tensioner; (m) connecting the tensioner to the rig floor; (n) releasably securing the base of the tensioner to the riser; and (o) moving the at least one spider beam slip from the spider beam slip opened position to the spider beam slip closed position, whereby the riser is maintained in place by the tensioner.

A further feature of the method for assembling a riser having a plurality of tubulars is that after step (h), steps (e) through (h) may be repeated with at least one additional tubular until the production riser has a predetermined length. Another feature of the method for assembling a riser having a plurality of tubulars is that the riser may include at least 10 tubulars. An additional feature of the method for assembling a riser having a plurality of tubulars is that the riser may include at least 50 tubulars. Still another feature of the method for assembling a riser having a plurality of tubulars is that the tensioner and each of the plurality of tubulars may be inserted through the rig floor and into the moonpool by lifting and positioning the tensioner and each of the plurality of tubulars with a crane. A further feature of the method for assembling a riser having a plurality of tubulars is that the tensioner and each of the plurality of tubulars may be inserted through the rig floor and into the moonpool by lifting and positioning the tensioner and each of the plurality of tubulars with a jack knife hoisting rig. Another feature of the method for assembling a riser having a plurality of tubulars is that step (e) may be achieved by: hoisting and positioning the second tubular above the first tubular and connecting the second tubular to the first tubular. An additional feature of the method for assembling a riser having a plurality of tubulars is that the tensioner may be connected to the rig floor by moving the at least one rig floor slip from the rig floor slip opened position to the rig floor slip closed position. Still another feature of the method for assembling a riser having a plurality of tubulars is that the tensioner may be connected to the rig floor by resting the tensioner on the rig floor. A further feature of the method for assembling a riser having a plurality of tubulars is that the tensioner may be connected to the rig floor by placing the tensioner in communication with a rotating bearing disposed on the rig floor.

The foregoing advantages have also been achieved through the present method for assembling a riser having a plurality of tubulars comprising the steps of: (a) providing a tensioner having a first tensioner end, a second tensioner end, a retracted position, an extended position, at least one mandrel, at least one upper flexjoint swivel assembly in communication with the at least one mandrel, at least one manifold in communication with the at least one upper flexjoint swivel assembly, the at least one manifold having a first radial fluid band and a second radial fluid band, at least one tensioning cylinder having a blind end, a rod end, and at least one transfer tubing, the blind end being in communication with the first radial fluid band, the transfer tubing being in communication with the second radial fluid band, and a base in communication with the rod end of each of the at least one tensioning cylinder; (b) providing a drilling or production facility having a rig floor and a moonpool disposed below the rig floor, the rig floor having at least one rig floor slip having a rig floor slip opened position and a rig floor slip closed position; (c) inserting a first tubular through the at least one rig floor slip, through the rig floor, and into the moonpool; (d) moving the at least one rig floor slip from the rig floor slip opened position to the rig floor slip closed position, whereby the first tubular is maintained in place by the at least one rig floor slip; (e) providing at least one spider beam, the at least one spider beam having at least one spider beam slip having a spider beam slip opened position and a spider beam slip closed position; (f) disposing the at least one spider beam slip around the first tubular and moving the at least one spider beam slip from the spider beam slip opened position to the spider beam slip closed position; (g) moving the at least one rig floor slip from the rig floor slip closed position to the rig floor slip opened position, whereby the first tubular is maintained in place by the at least one spider beam slip; (h) lowering the tensioner over the first tubular, through the rig floor, and into the moonpool, whereby the first tubular passes through the tensioner; (i) connecting the tensioner to the rig floor; (j) releasably securing the base of the tensioner to the first tubular; (k) moving the at least one spider beam slip from the spider beam slip closed position to the spider beam slip opened position, whereby the first tubular is maintained in place by the tensioner; (l) connecting a second tubular to the first tubular thereby forming a riser having a plurality of tubulars; (m) moving the at least one rig floor slip from the rig floor closed position to the rig floor opened position; (n) inserting the second tubular through the at least one rig floor slip, through the rig floor, through the tensioner, and into the moonpool, thereby moving the tensioner from the retracted position to the extended position; (o) moving the at least one rig floor slip from the rig floor slip opened position to the rig floor slip closed position; (p) releasing the base of the tensioner from the riser, whereby the riser is maintained in place by the at least one rig floor slip; (q) moving the tensioner from the extended position to the retracted position; and (r) releasably securing the base of the tensioner to the riser.

A further feature of the method for assembling a riser having a plurality of tubulars is that the method further includes the step of: (s) repeating steps (l) through (r) with at least one additional tubular until the riser has a predetermined length. Another feature of the method for assembling a riser having a plurality of tubulars is that the second tubular may be connected to the first tubular to form the riser having a plurality of tubulars prior to step (h). An additional feature of the method for assembling a riser having a plurality of tubulars is that at least two additional tubulars may be connected to the riser prior to step (h) by: moving the at least one rig floor slip from the rig floor closed position to the rig floor opened position; connecting the at least one additional tubular to the riser; inserting the at least one additional tubular through the at least one rig floor slip, through the rig floor, and into the moonpool; moving the at least one rig floor slip from the rig floor slip opened position to the rig floor slip closed position, whereby the riser is maintained in place by the at least one rig floor slip; repeating the above steps with at least one additional tubular until the production riser has a predetermined length. Still another feature of the method for assembling a riser having a plurality of tubulars is that the method may further comprise the step of: removing the at least one spider beam after step (k). A further feature of the method for assembling a riser having a plurality of tubulars is that the method may further comprise the steps of: connecting a final tubular to the production riser; and inserting the final tubular through the at least one rig floor slip, through the rig floor, and into the moonpool.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DESCRIPTION OF SPECIFIC EMBODIMENTS

In one aspect, the invention comprises elements that when assembled form a unitary, integral, co-linear tensioner. The tensioner may be used to replace both conventional and direct acting tensioning systems. Further, variations of the tensioner may be utilized in both drilling and production riser applications.

Continuous monitoring and system management provides control of the large instantaneous loads and riser recoil/upstroke in the event of an unplanned or emergency disconnect. Further, the system is designed to operate at a 100% level with two tension cylinders isolated which is normal practice in tensioning system operations.

Figure 1:
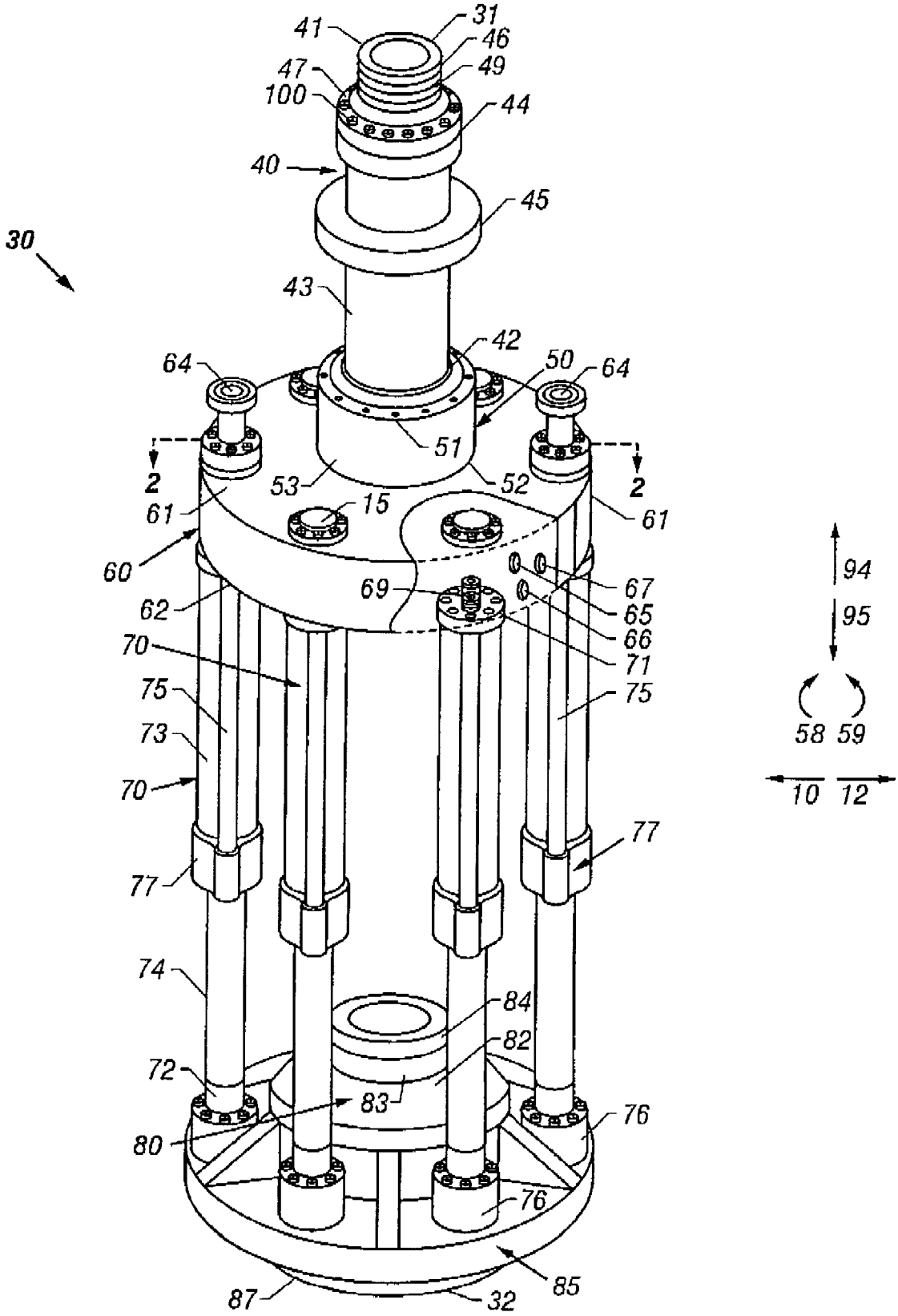
FIG. 1 is a perspective view of one specific embodiment of the tensioner of the present invention.
Figure 7:
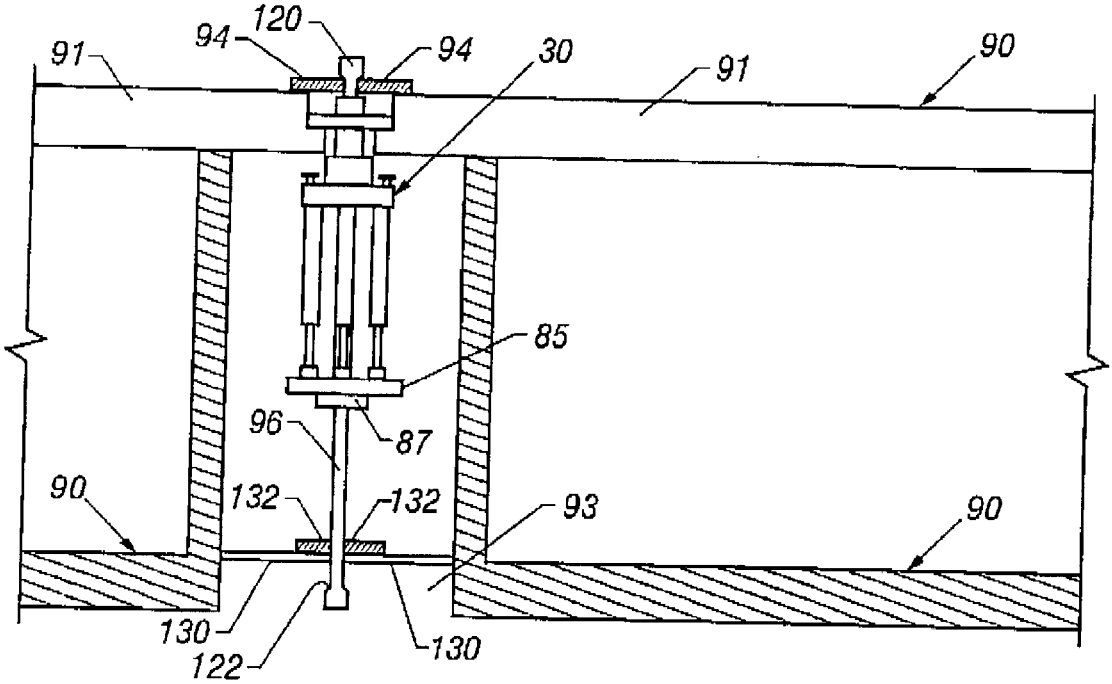
FIG. 7 is a side view of a drilling or production facility showing a tensioner of the present invention in its retracted position, inserted in the drilling or production facility, and having a tubular passing through the tensioner.
Figure 8:
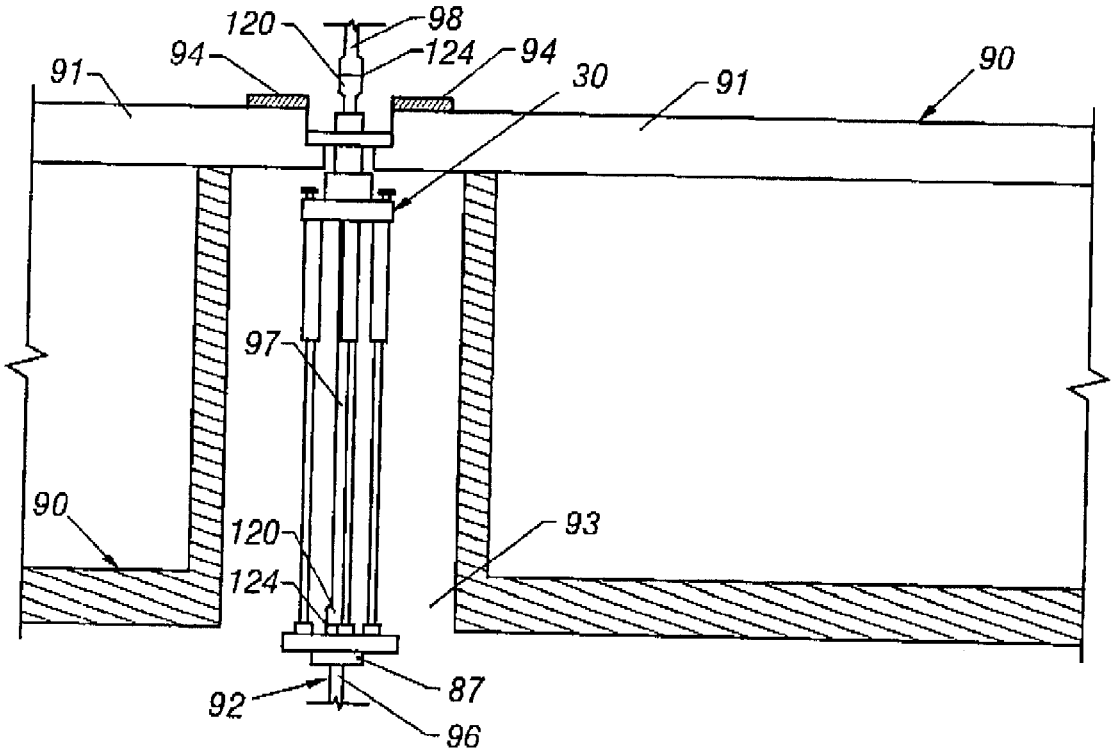
FIG. 8 is a side view of a drilling or production facility showing a tensioner of the present invention in its extended position, inserted in the drilling or production facility, and having riser including a plurality of tubulars passing through the tensioner.

Referring now to FIG. 1, broadly, the present invention is directed to tensioner 30 having a first tensioner end 31, a second tensioner end 32, a retracted position (FIG. 7), and an extended position (FIG. 8). Preferably, tensioner 30 includes the following sub-assemblies: at least one mandrel, or spool, 40; at least one upper flexjoint, or bearing, swivel assembly 50; at least one manifold assembly, or manifold, 60; at least one tensioning cylinder, or cylinder, 70; and at least one base 85. Base 85 facilitates the communication of second tensioner end 32 to additional equipment or conduits, e.g., riser string or blow-out preventer stack. In a preferred embodiment, base 85 includes riser connector member 87 discussed below in greater detail. Upper flexjoint swivel assembly 50, and lower flexjoint swivel assembly 80 compensate for vessel offset i.e., vessel position in relationship to the well bore center and riser angle.

In a specific embodiment, tensioner 30 further includes at least one lower flexjoint, or bearing, swivel assembly 80 discussed below in greater detail.

Mandrel 40 includes first mandrel end 41, second mandrel end 42, mandrel body 43, hang-off joint 44, and at least one hang-off donut 45. Mandrel 40 may be connected to a diverter assembly (not shown), through an interface mandrel 46 having a mandrel lower connection flange 47 which may be connected to hang-off joint 44 through any method known to persons of ordinary skill in the art. As shown in FIG. 1, mandrel lower connection flange 47 is connected to hand-off joint 44 through the use of bolts 100.

Figure 6:
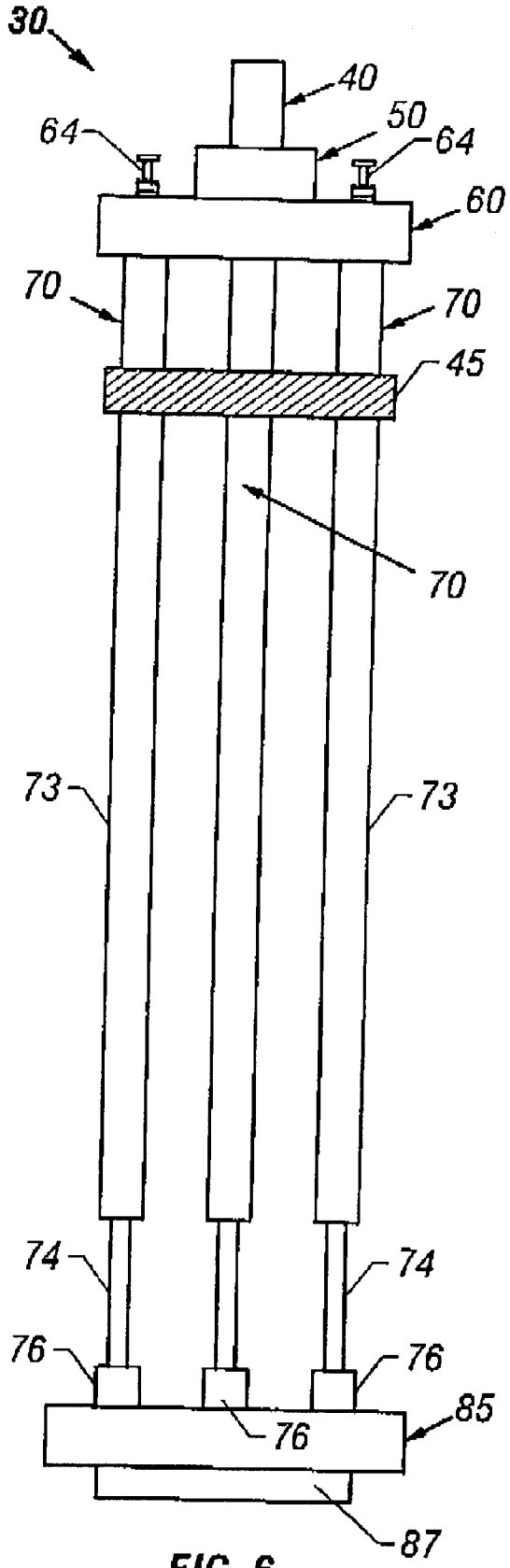
FIG. 6 is a side view of another specific embodiment of the tensioner of the present invention.

Hang-off donut 45 is used to interface with a hydraulic support spider frame (not shown) which is generally supported under the sub-structure of the vessel or platform. This allows for the complete tensioner 30, including the riser and blow-out preventer (B.O.P.) stack, to be disconnected from the wellhead and "hard hung-off" and supported within the spider frame and beams when disconnected from the diverter or riser assembly. This arrangement allows for the complete tensioner 30 to be disconnected from the diverter and moved horizontally, such as via hydraulic cylinders, under the sub-structure away from the wellbore, thereby allowing access to the wellbore center and, providing clearance for the maintenance of the B.O.P. and the installation and running of well interface equipment, particularly production trees and tooling packages. Hang-off donut 45 may be integral to both the upper flexjoint swivel assembly 50 and manifold 60. Alternatively, and preferably, hang-off donut 45 is disposed along the tensioning cylinders 70, thereby capturing the tensioning cylinders 70 so that hang-off donut 45 is disposed more centrally to the overall length of tensioner 30 (FIG. 6). In this position, hang-off donut 45 permits transference of axial tension load from cylinder casing 73 of tensioning cylinder 70 to mandrel 40 and then directly to the rig structure (not shown).

Figure 3:
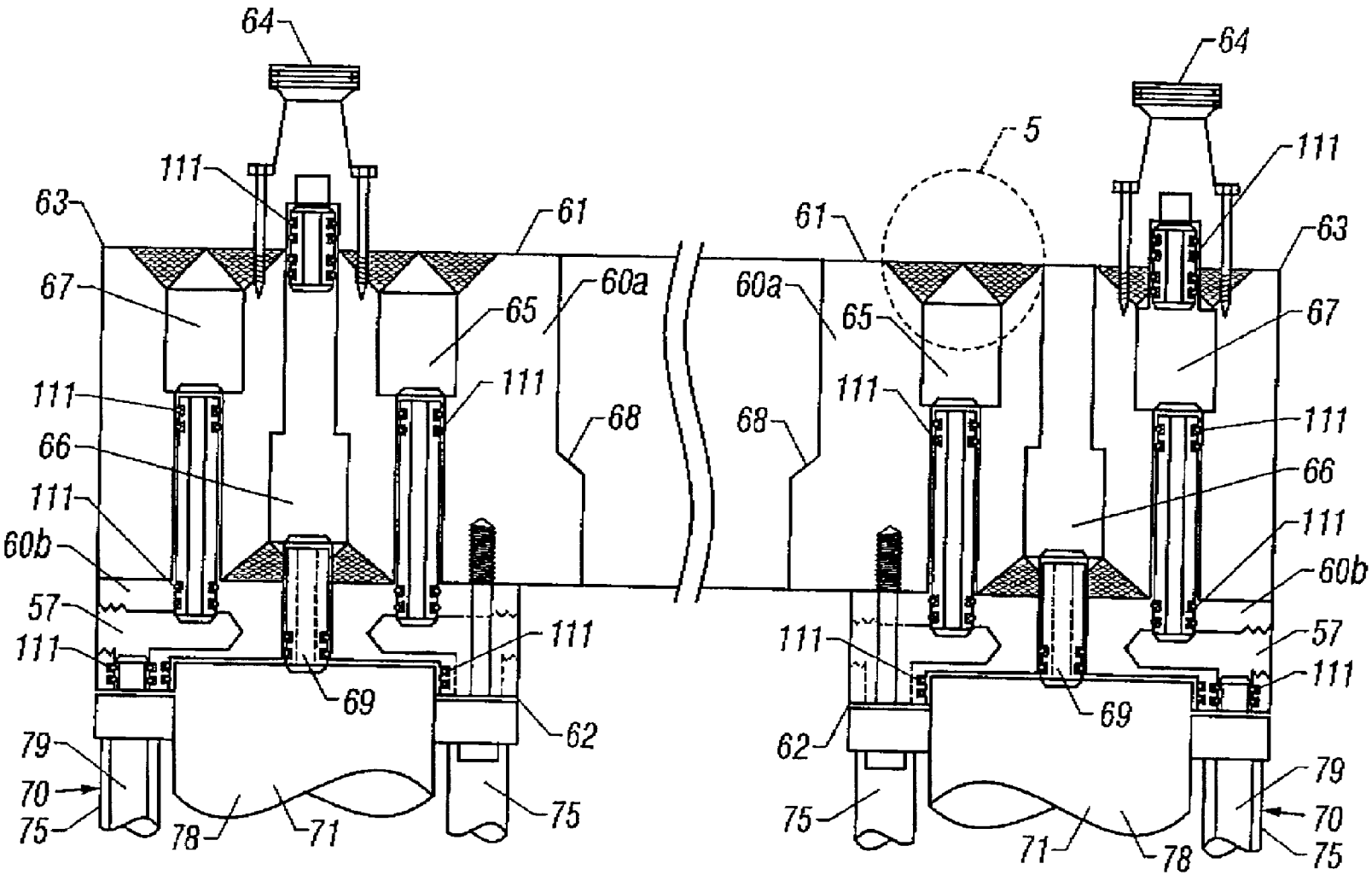
FIG. 3 is a cross-sectional view of the manifold shown in FIG. 2 taken along line 3—3.

Second mandrel end 42 is in communication with upper flexjoint swivel assembly, or upper bearing swivel assembly, 50. Upper flexjoint swivel assembly 50 includes first upper flexjoint end 51, second upper flexjoint end 52, and housing 53 having at least one swivel member, e.g., bearings, which may be disposed within housing 53 as shown in FIG. 3. Swivel members of upper flexjoint swivel assembly 50 permit rotational movement of manifold 60, tensioning cylinders 70, and lower swivel assembly 80 in the direction of arrows 58, 59 and arrows 10, 12. This arrangement allows for mandrel 40 to be locked into a connector (not shown) or rig floor 91 (FIGS. 7 and 8) supported under the diverter housing (not shown) which maintains the upper flexjoint swivel assembly 50, and riser 92 (FIGS. 8 and 9) in a locked, static position, while allowing tensioning cylinder 70 and lower flexjoint swivel assembly 80 to rotate (FIG. 8). Upper flexjoint swivel assembly 50 provides angular movement of at approximately 15 degrees over 360 degrees compensating for riser angle and vessel offset. Upper flexjoint swivel assembly 50 may be any shape or size desired or necessary to permit movement of manifold assembly 60, tensioning cylinder 70, and lower flexjoint swivel assembly 80 to a maximum of 15 degrees angular movement in any direction over 360 degrees. As shown in FIG. 1, upper flexjoint swivel assembly 50 is cylindrically shaped.

Second upper flexjoint end 52 is in communication with manifold 60 (discussed in greater detail below) through any method or device known to persons of ordinary skill in the art, e.g., mechanical connector, or bolts 100 (FIG. 1). Preferably, upper flexjoint swivel assembly 50 is integral with tensioner 30. Upper flexjoint swivel assembly 50 permits manifold 60, and thus, the mounted tensioning cylinders 70, to move in the direction of arrows 58, 59 when in tension thereby minimizing the potential to induce axial torque and imposing bending forces on the mounted tensioning cylinders 70.

While manifold 60 may be fabricated from a solid piece of material, e.g., stainless steel, preferably manifold 60 is fabricated from two separate pieces, or sections, of material, upper manifold section 60*a*, and lower manifold section 60*b*. Manifold 60 may also be a welded fabrication of plate or fabricated from one or more castings.

Figure 2:
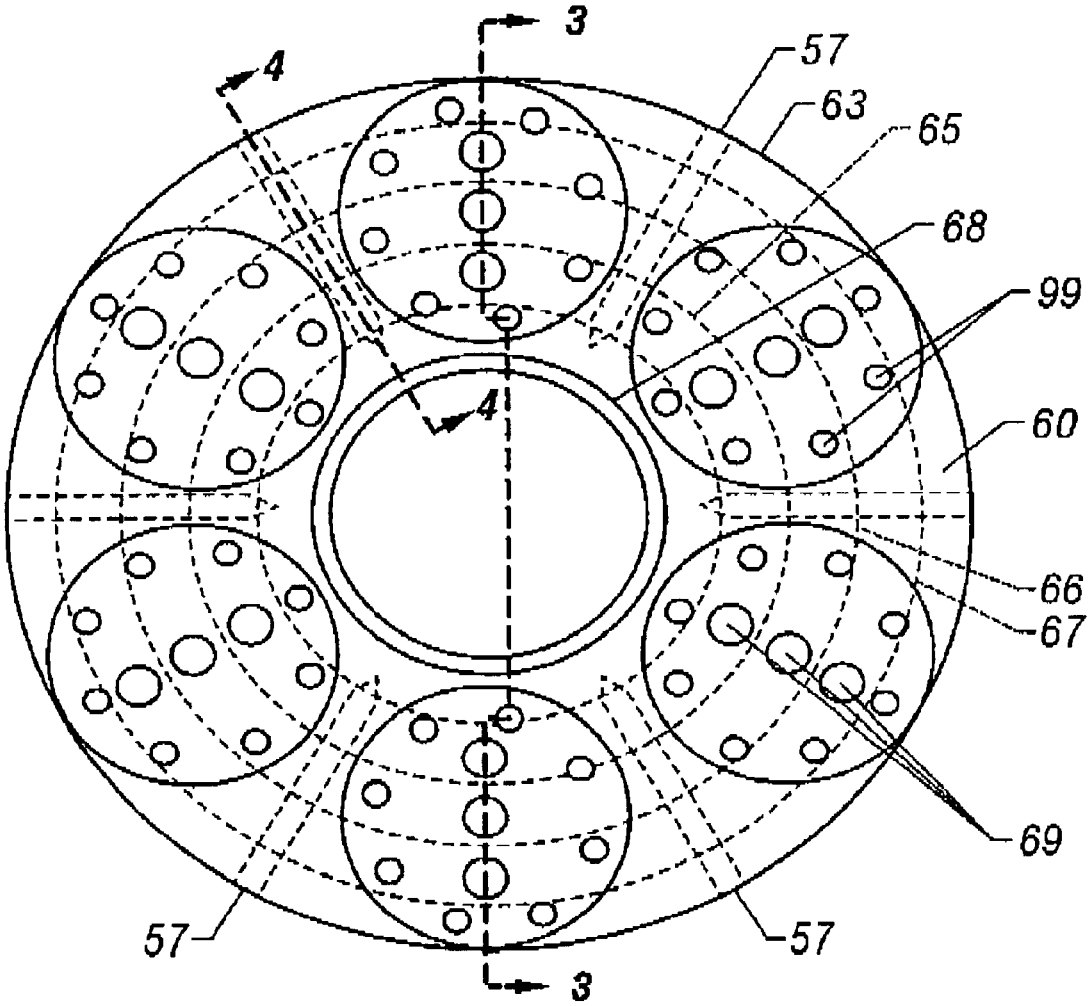
FIG. 2 is a cross-sectional view of the manifold of the tensioner shown in FIG. 1 taken along line 2—2.

As illustrated in detail in FIGS. 2–3, manifold 60 includes top surface 61, bottom surface 62, manifold body 63, and bearing landing flange 68. Top surface 61 of manifold 60 preferably includes at least one control interface 64 (FIG. 1). Control interface 64 is preferably in communication with at least one tensioner cylinder 70 and at least one control source (not shown), e.g., through the use of gooseneck hose assemblies known to persons of ordinary skill in the art. Examples of suitable control sources include, but are not limited to, atmospheric pressure, accumulators, air pressure vessels (A.P.V.), and hoses for connecting the gooseneck hose assembly to the accumulator and air pressure vessel. As shown in FIGS. 1–2, tensioner 30 includes two control interfaces 64 and six tensioning cylinders 70.

Control interface 64 permits pressure, e.g., pneumatic and/or hydraulic pressure, to be exerted from the control source, through control interface 64, through sub seal 69, into manifold 60, into and through radial fluid band, e.g., 65, 66, 67, and into tensioning cylinder 70 to provide tension to tensioner 30 as discussed in greater detail below and to move tensioner 30 from the retracted position to the extended position and vice versa. It is to be understood that only one control interface 64 is required, although more than one control source 64 may be employed. Further, it is to be understood that one control interface 64 may be utilized to facilitate communication between all radial bands, e.g., 65, 66, 67, and the control source.

In one specific embodiment, control interface 64 is not required to be in communication with radial fluid band 66. In this embodiment, radial fluid band 66 may be opened to the atmosphere or may be blocked by cover 15 (FIG. 1).

Manifold 60 includes at least two, and preferably three, radial fluid bands, 65, 66, 67, which interface with blind end 71 and transfer tubing 75 of at least one tensioning cylinder 70 via seal subs 69 that intersect fluid bands 65, 66, 67 thereby providing isolated common conduits to transfer tubing 75 and blind end 71 of each tensioning cylinder 70 (FIG. 3). As further shown in FIG. 3, radial fluid bands 65, 66, 67 preferably include two upper radial bands 65, 67 and one lower radial band 66. Alternatively, radial fluid bands 65, 66, 67 of manifold 60 may be arranged with two radial fluid bands, e.g., 65, 67, machined below the other radial fluid band, e.g., 66. In still another embodiment, radial fluid bands 65, 66, 67 may be machined co-planar to each other.

It is to be understood that one or more radial fluid bands, e.g., 65, 66, 67, may be in communication with either blind end 71 or transfer tubing 75; provided that at least one radial fluid band is in communication with each of blind end 71 and transfer tubing 75. For example, as shown in FIG. 3, two radial fluid bands 65, 67 are in communication with transfer tubing 75 and one radial fluid band 66 is in communication with blind end 71.

While each of radial fluid band 65, 66, 67 is preferably in communication with control interface 64, as shown in FIG. 3, the at least one radial fluid band in communication with the blind end 71 (radial fluid band 66 as shown in FIG. 3), may be filled with inert gas at a slight pressure above atmospheric pressure or it may be opened to the atmosphere to provide the required pressure differential into cylinder cavity 78.

Figure 4:
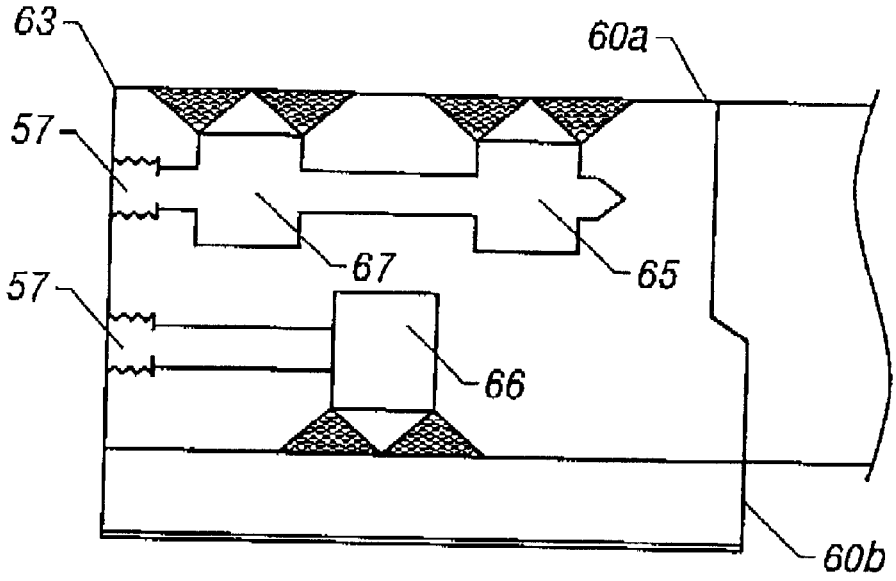
FIG. 4 is a cross-sectional view of the manifold shown in FIG. 2 taken along line 4—4.
Figure 5:
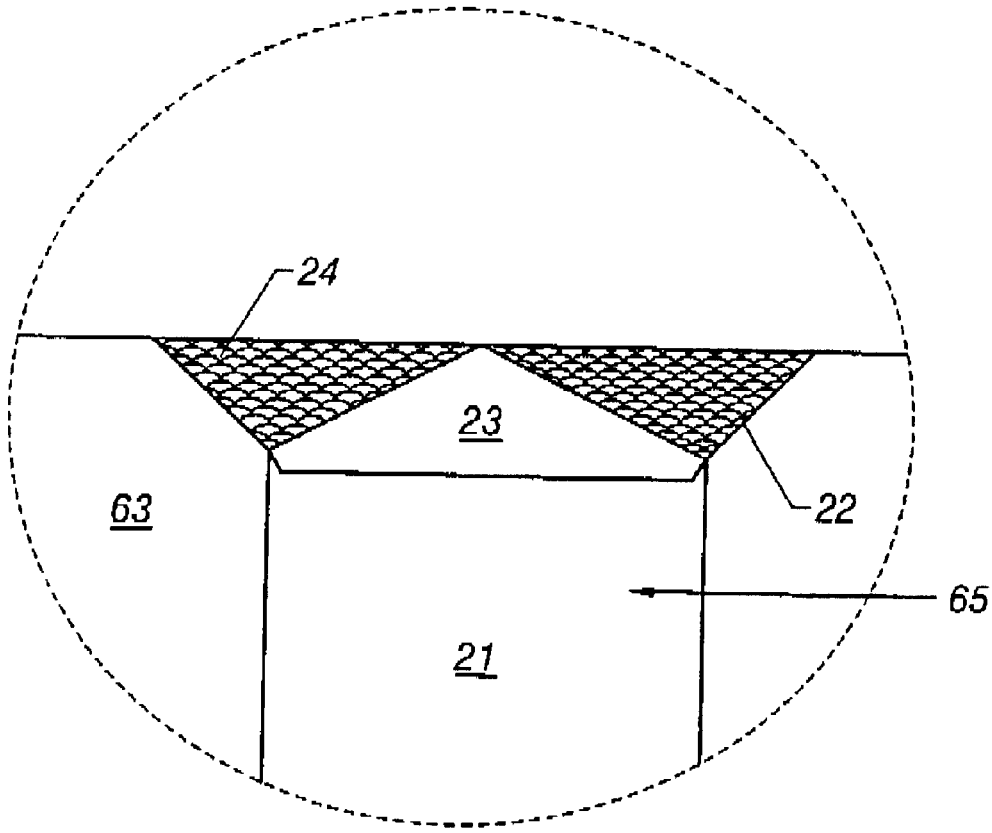
FIG. 5 is cross-sectional view of one of the radial fluid bands shown in FIG. 3.

Referring now to FIG. 4, the creation of radial fluid bands 65, 66, 67 may be accomplished by machining channels 21 in manifold body 63 to the dimensions desired or established for appropriate port volume. Machined channels 21 are profiled with weld preparation 22 which matches preparation of filler ring 23 which is welded 24 into machined channel 21 in manifold body 63. Manifold 60 is then face machined, seal sub counterbores are machined, and tensioning cylinder mounting bolt holes 99 (FIG. 2) drilled. Cross drilled transfer ports 57 are also drilled. This arrangement provides a neat, clean, low maintenance tensioning cylinder interface alleviating the need for multiple hoses and manifolding, i.e., each tensioning cylinder 70 does not require a separate control interface 64.

Top surface 61 of manifold 60 is machined to accept upper flexjoint swivel assembly 50. Manifold ports 57 facilitate the communication of the radial fluid bands 65, 66, 67 with control instrumentation, e.g., a transducer.

While manifold 60 may be fabricated or machined in any shape, out of any material, and through any method known to persons of ordinary skill in the art, preferably manifold 60 is fabricated and machined in a radial configuration as discussed above, out of stainless steel.

Each tensioning cylinder 70, discussed in greater detail below, is positioned on a radial center which aligns the porting, i.e., transfer tubing 75 and blind end 71, to the appropriate radial fluid band 65, 66, 67. Seal subs 69 having resilient gaskets 111, e.g., O-rings, which are preferably redundant as shown in FIG. 3, to ensure long term reliability of the connection between control interface 64 and manifold 60 and between radial fluid bands, 65, 66, 67 and transfer tubing 75 and blind end 71.

Each tensioner cylinder 70 preferably includes blind end 71, rod end 72, cylinder casing 73, rod 74, transfer tubing 75 having transfer tubing cavity 79, cylinder head 77, and cylinder cavity 78. While cylinder casing 73 may be formed out of any material known to persons of ordinary skill in the art, cylinder casing 73 is preferably formed out of carbon steel, stainless steel, titanium, or aluminum. Further, cylinder casing 73 may include a liner (not shown) inside cylinder casing 73 that contacts rod 74.

Transfer tubing 75 may also be formed out of any material known to persons of ordinary skill in the art. In one specific embodiment, transfer tubing 75 is formed out of stainless steel with filament wound composite overlay.

Each tensioner cylinder 70 permits vertical movement of tensioner 30 from, and to, the retracted position, i.e., each rod 74 is moved into the respective cylinder casing 73 (FIG. 7). Each tensioner cylinder 70 also permits vertical movement of tensioner 30 from, and to, the extended position, i.e., each rod 74 is moved from within the respective cylinder casing 73 (FIG. 8). It is noted that tensioner 30 includes numerous retracted positions and extended positions and these terms are used merely to describe the direction of movement. For example, movement from the retracted position to the extended positions means that each rod 74 is being moved from within the respective cylinder casing 73 and movement form the extended position to the retracted position means that each rod 74 is being moved into the respective cylinder casing 73. The use of the term "fully" preceding extended and retracted is to be understood as the point in which rod 74 can no longer be moved from within cylinder casing 73 ("fully extended"), and the point in which rod 74 can no longer be moved into cylinder casing 73 ("fully retracted").

Tensioner 30 may be moved from the retracted position to the extended position, and vice versa, using any method or device known to persons skilled in the art. For example, tensioner 30 may be moved from the retracted position to the extended position by gravity or by placing a downward force on the tubular using the lifting device. Alternatively, at least one control source in communication with tensioner 30 as discussed above to facilitate movement of tensioner 30 from the extended position to the retracted position and vice versa.

In the specific embodiment shown in FIG. 1, each cylinder rod end 72 includes at least one flexjoint bearing 76. Each flexjoint bearing 76 permits rotational movement of each tensioning cylinder 70 in the direction of arrows 58, 59 and arrows 10, 12 in the same manner as discussed above with respect to upper flexjoint swivel assembly 50. As shown in FIG. 1, each flexjoint bearing 76 is in communication with base 85, and each blind end 71 is in communication with bottom surface 62 of manifold 60. Alternatively, each flexjoint bearing 76 may be in communication with lower flexjoint swivel assembly 80. Flexjoint bearing 76 preferably has a range of angular motion of+/−15 degrees for alleviating the potential to induce torque and/or bending forces on cylinder rod 74.

As shown in FIGS. 1–3, blind ends 71 are drilled with a bolt pattern to allow bolting in a compact arrangement on bottom surface 62 of manifold 60. Preferably, a plurality of appropriately sized tensioning cylinders 70 equally spaced around manifold 60 are employed to produce the tension required for the specific application. Tensioning cylinders 70 are preferably disposed with rod end 72 down, i.e., rod end 72 is closer to base 85, or lower flexjoint swivel member 80, than to manifold 60. It is to be understood, however, that one, or all, tensioning cylinders 70 may be disposed with rod end 72 up, i.e., rod end 72 is closer to manifold 60.

Each tensioning cylinder 70 is designed to interface with at least one control source, e.g., air pressure vessels and accumulators via transfer piping 75 and manifold 60 and via blind end 71 and manifold 60. However, not all tensioning cylinders 70 must be in communication with the at least one radial band 65, 66, 67.

While it is to be understood that tensioning cylinder 70 may be formed out of any material known to persons of ordinary skill in the art, preferably, tensioning cylinder 70 is manufactured from a light weight material that helps to reduce the overall weight of the tensioner 30, helps to eliminate friction and metal contact within the tensioning cylinder 70, and helps reduce the potential for electrolysis and galvanic action causing corrosion. Examples include, but are not limited to, carbon steel, stainless steel, aluminum and titanium.

In one specific embodiment, lower flexjoint swivel assembly 80 is in communication with base 85. Lower flexjoint swivel assembly 80 consists of inner mandrel 83 and outer radial member, or housing, 82 which contains at least one swivel member (not shown), e.g., bearings. Inner mandrel 83 may include flange 84 which is in communication with riser 92 (FIG. 8).

Swivel members of lower flexjoint swivel assembly 80 permit movement of upper flexjoint swivel assembly 50, manifold 60, tensioning cylinder 70, and lower flexjoint swivel assembly 80 in the direction of arrows 58, 59 and arrows 10, 12. As with upper flexjoint swivel assembly 50, lower flexjoint swivel assembly 80 is employed to further alleviate the potential for induced axial torque while tensioner 30 is in tension. Preferably, lower flexjoint swivel assembly 80 has a range of angular motion of +/−15 degrees for alleviating the potential to induce torque and/or bending forces on tensioner 30.

Lower flexjoint swivel assembly 80 may be any shape or size desired or necessary to permit radial movement of upper flexjoint swivel assembly 50, manifold assembly 60, tensioning cylinder 70, and lower flexjoint swivel assembly 80 in the direction of arrows 58, 59. As shown in FIG. 1, lower flexjoint swivel assembly 80 is preferably cylindrically shaped.

Base 85 facilitates connecting second end 32 of tensioner 30 to other subsea appliances or equipment, e.g, blowout preventer stacks, production trees, and manifolds, and riser components, e.g., tubulars. Preferably, base 85 is equipped with riser connector member 87 which is common to the flange/connectors employed on the riser string to facilitate connection of tensioner 30 to riser 92 or other components. Examples of riser connecter member 87 known in the art include latch dog profile as discussed in greater detail below regarding mandrel 40, locking rings, load rings, and casing slips.

Base 85 also includes a plurality of flexjoint bearings 76 for connecting tensioning cylinder 70 to base. Flexjoint bearing 76 alleviate the potential for tensioning cylinder 70 and rod 74 bending movement which would cause increased wear in the packing elements (not shown) in the gland seal (not shown) disposed at the interface between rod 74 and cylinder casing 73. Each flexjoint bearing 76 provides an angular motion of range of 15 degrees over 360 degrees in the direction of arrows 58, 59 and arrows 10, 12.

In drilling applications, tensioner 30 is connected to the diverter (not shown), which is generally supported under the drilling rig floor sub-structure through any method or manner known by persons skilled in the art. In one specific embodiment, the connection between tensioner 30 and the diverter may be accomplished by means of a bolted flange, e.g., via a studded connection. In another specific embodiment, tensioner 30 is connected to the diverter by inserting mandrel interface 47 into a connector (not shown) attached to the diverter. In this embodiment, interface mandrel 46 includes latch dog profile 49 that connects to the connector via matching latch dogs which may be hydraulically, pneumatically, or manually energized. In addition, a metal to metal sealing gasket profile is preferably machined in the top of mandrel 40 to effect a pressure containing seal within the connector.

A production or a drilling riser, collectively "riser," can be run to depth with tensioner 30 using a lifting device, e.g., a crane, jack knife hoisting rig, rack and pinion elevator assembly, or other suitable lifting device. Therefore, in one embodiment, the production riser for drill step tests and other uses, or, in another embodiment, the drilling riser, can be assembled without the need for large amounts of heavy equipment, e.g., a full size derrick.

Figure 9:
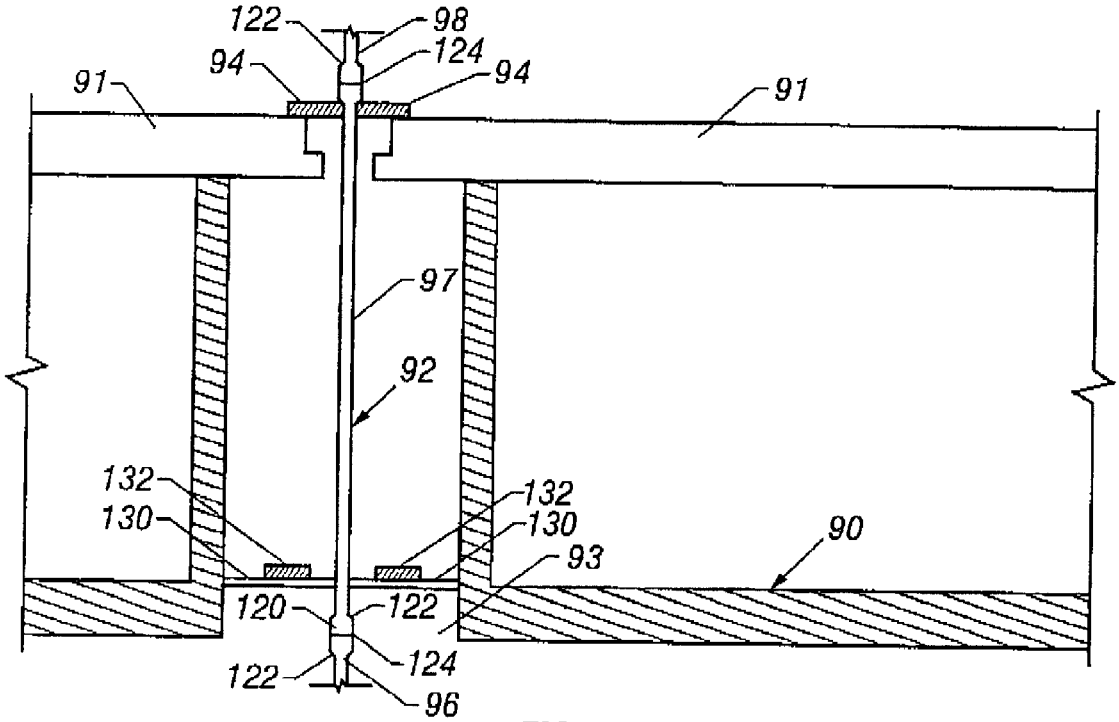
FIG. 9 is a side view of a drilling or production facility showing a riser having a plurality of tubulars inserted in the drilling or production facility.

Referring now to FIGS. 7–9, broadly, the method of assembling riser 92 having a plurality of tubulars, comprises the steps of providing tensioner 30 described in greater detail above, and drilling or production facility 90, e.g., a drilling/production vessel or platform, having rig floor 91 and an opening, e.g., moonpool 93, through rig floor 91 of facility 90 providing access from rig floor 91 to the surface of the water. Tensioner 30 includes weight and size dimensions such that existing lifting devices can handle and maintain tensioner 30 to facilitate assembly riser 92.

While the methods of the invention will be described in greater detail referring to rig floor 91 of a vessel, it is to be understood that rig floor 91 may be disposed on a platform. It is also to be understood that rig floor 91 is any area located on the vessel or platform above moonpool 93 where activity that might be disrupted by, or disruptive to, assembling riser 92, is not taking place. In this regard, rig floor 91 preferably includes sufficient space for all needed ancillary equipment such as air pressure vessels, hydraulic accumulators, valves, riser disconnect management system, pipe handling, pipe make-up/break out equipment, e.g., iron roughnecks, slips, controls, etc. (all not shown).

Rig floor 91 also includes at least one rig floor slip 94 having a rig floor slip opened position (FIG. 8) and a rig floor slip closed position (FIGS. 7 and 9). While in the rig floor opened position, the plurality of tubulars, e.g., tubulars 96, 97, 98, are permitted to be inserted into and through rig floor slip 94, into and through rig floor 91, and into moonpool 93. Ultimately, most, but not all, e.g., the final few tubulars, will be inserted through moonpool 93, below the vessel or platform, and into the water. While in the rig floor closed position, tubulars are maintained, or held, in place so that other work may be performed on, or around, the tubular as discussed in greater detail below.

Each tubular each tubular includes a first end, a second end, and length. Each end of the tubular preferably is flared or includes a flange 120 to facilitate tools and equipment, e.g., rig floor slip 94, spider beam slip 132, and tensioner 30, to securely hold the tubular in place. Flange 120 forms a flange surface or neck 122 to assist in this manner. Alternatively, each tubular may include a collar or other flange device secured along the length of the tubular as desired or necessary to facilitate hoisting, positioning, and connecting each tubular to riser 92 and maintaining each tubular or riser 91 in a desired position. Generally, flange 120 or other device is located at or near each end of the tubular. Further, as shown in FIGS. 8 and 9, tubulars 96, 97, 98 are connected to each other at tubular joint 124 to form riser 92.

In one specific embodiment of the method for assembling riser 92 having a plurality of tubulars, tensioner 30 is hoisted by the lifting device and inserted through rig floor 91 and into moonpool 93 so that second end 32 of tensioner 30 is hanging fee within moonpool 93. Tensioner 30 is connected to rig floor 91 such that tensioner 30 is supported by rig floor 91. Tensioner 30 may be connected to rig floor 91 through any method or device known to persons skilled in the art. For example, tensioner 30 may be connected to rig floor 91 by moving rig floor slip 94 from the rig floor slip opened position to the rig floor slip closed position. Alternatively, tensioner 30 may be connected to rig floor 91 by resting hang-off donut 45 or manifold 60 on rig floor 91. Tensioner 30 may also be connected to rig floor 91 by placing tensioner 30, e.g., hang-off donut 45 or manifold 60, in communication with a rotating bearing (not shown) disposed on rig floor 91.

In this embodiment, first tubular 96 is hoisted by lifting device, positioned, and inserted through rig floor 91, through tensioner 30, and into moonpool 93. Rig floor slip 94 is disposed around first tubular 96 and is moved from the rig floor slip opened position to the rig floor slip closed position. In the rig floor slip closed position, rig floor slip 94 is positioned and secured around first tubular 96 and is capable of maintaining first tubular 96, and subsequently assembled tubulars, i.e., riser 92, in place, i.e., supporting the entire weight of riser 92 as it is being assembled in accordance with the methods of the present invention (FIG. 7). As shown in FIGS. 7 and 9, rig floor slip 94 is secured around a flange 120 or collar disposed around first tubular 96, as well as all subsequently assembled tubulars.

Second tubular 97 is then hoisted by the lifting device, positioned, and vertically connected to first tubular 96 in an end-to-end arrangement to form riser 92 having a plurality of tubulars. Rig floor slip 94 is moved from the rig floor closed position to the rig floor opened position and second tubular 97 is inserted through rig floor 91, through tensioner 30, and into moonpool 93.

Base 85 of tensioner 30 is releasably secured to riser 92 through any method or device known to persons skilled in the art. Preferably, base 85 includes riser connector member 87, e.g., latch dogs, a locking ring, a load ring, or casing slips disposed around the tubular. Preferably, riser connector member 87 is powered, either pneumatically or hydraulically to facilitate remotely securing and releasing the tubular.

Rig floor slip 94 is once again moved from the rig floor slip opened position to the rig floor slip closed position so that riser 92 is maintained in place by rig floor slip 94. Third tubular 98 is hoisted by the lifting device, positioned, and connected to second tubular 97 in the same manner described above. Rig floor slip 94 is then moved from the rig floor closed position to the rig floor opened position and third tubular 98 is inserted through rig floor slip 94, through rig floor 91, through tensioner 30, and into moonpool 93. Therefore, tensioner 30 is moved from the retracted position to the extended position (FIG. 8). As mentioned above, if necessary to facilitate movement of tensioner 30 from the retracted position to the extended position, at least one control source in communication with tensioner 30 may be activated.

Rig floor slip 94 is moved from the rig floor slip opened position to the rig floor slip closed position, so that riser 92 is maintained in place by rig floor slip 94. Base 85 of tensioner 30 is released from first tubular 96 thereby permitting tensioner 30 to be moved from the extended position to the retracted position. Preferably, at least one control source in communication with tensioner 30 is activated to facilitate movement of tensioner 30 from the extended position to the retracted position. Base 85 is then releasably secured to riser 92.

The assembly of riser 92 is then continued by connecting a fourth tubular (not shown) to third tubular 98 and inserting the fourth tubular through rig floor slip 94, through rig floor 91, through tensioner 30, and into moonpool 93, thereby moving tensioner 30 from the retracted position to the extended position. Rig floor slip 94 is moved from the rig floor slip opened position to the rig floor slip closed position so that riser 92 is maintained in place by rig floor slip 94. Base 85 of tensioner 30 is then released from second tubular 97 and tensioner 30 is moved from the extended position to the retracted position as previously described. Base 85 is then releasably secured to third tubular 98 and at least one additional tubular is hoisted, positioned, connected, and inserted in the manner described above until the riser has a predetermined length.

Preferably, a final tubular is hoisted and connected to riser 92 in the same manner described above. In so doing, the final tubular is inserted through rig floor slip 94, through rig floor 91, through tensioner 30, and into moonpool 93. The final tubular is not secured to tensioner 30. Instead, the final tubular is permitted to move vertically through tensioner 30, such that approximately 3 to 5 feet of the final tubular is always extending upwards from tensioner 30. To achieve the result of having only 3 to 5 feet of the final tubular extending upwards from tensioner 30, the final tubular is usually fabricated to the necessary length.

Additionally, the final tubular, or one of the previously assembled tubulars located close to, i.e., within three tubular lengths from the top of riser 92 extending upward out of the water, tensioner 30 and rig floor 91, preferably includes a tensioning ring (not shown). Tensioning ring is not inserted through rig floor slip 94, rig floor 91, or tensioner 30. Instead, tensioning ring is disposed above rig floor slip 94, rig floor 91, and tensioner 30 and provides support to riser 92. Tensioning ring is generally more robust than riser connector member 87 to provide long-term support to riser 92 and withstand the strong external forces, e.g., wind and current, exerted on the vessel, platform, and riser 92.

Tensioner 30 provides constant tension, with overpull, and support to riser 92 during the assembly of riser 92. Tensioner 30 also provides rotational or axial movement, and angular movement caused by vessel motion through upper flexjoint swivel assembly 50 and, in some embodiments, lower flexjoint swivel assembly 80.

In another specific embodiment, first tubular 96 is hoisted, positioned, and inserted through rig floor slip 94 and rig floor 91. Rig floor slip 94 is then moved from the rig floor slip opened position to the rig floor slip closed position. Spider beam 130 is then positioned below rig floor 91 (FIGS. 7 and 9). Spider beam 130 includes at least one spider beam slip 132 having a spider beam slip opened position (FIG. 9) and a spider beam slip closed position (FIG. 7). Spider beam slip 132 is placed in the spider beam closed position and rig floor slip 94 is moved from the rig floor slip closed position to the rig floor slip opened position. Therefore, riser 92 is maintained in place by spider beam slip 132.

Tensioner 30 is then hoisted, positioned, and inserted over first tubular 96 and secured to rig floor 91. Base 85 of tensioner 30 is releasably secured to first tubular 96 and rig floor slip 94 is moved from the rig floor slip closed position the rig floor opened position. Second tubular 97 is then hoisted, positioned, and inserted through rig floor slip 94, rig floor 91 and tensioner 30 in the same manner previously described. Rig floor slip 94 is moved from the rig floor opened position to the rig floor closed position. Additional tubulars can then be assembled in the same manner until riser 92 has a predetermined length. Alternatively, one or more tubulars can be connected to first tubular 96 to assemble riser 92 having a predetermined length prior to hoisting, positioning, and inserting tensioner 30 over riser 92 (FIG. 9). One limitation, however, on this specific embodiment is that the weight of riser 92 must not exceed the supporting capability of the lifting device.

In one specific embodiment, at least one spider beam 130 (FIG. 7) may be installed prior to hoisting, positioning, and inserting first tubular 96 through rig floor slip 94, rig floor 91, through tensioner 30, and into moonpool 93, thereby facilitating connection of a subsea appliance or other device to the lower end of first tubular 96 while first tubular 96 is held in position by rig floor slip 94. Spider beam 130 is preferably removed prior to connecting additional tubulars to provide tensioner 30 with greater angular movement. As riser 92 is assembled the subsea appliance or other device is lowered toward the wellhead.

Further, a blowout preventer stack, diverter, or other device may be installed on the upper end of the final tubular.

In another specific embodiment, after riser 92 and blowout preventer stack are assembled, drill stem test flow lines are installed and tested and the drill stem test is conducted. Once completed, riser 92 can be retrieved, or disassembled, using the reversal of steps for assembling the riser 92 discussed above. Likewise, riser 92 may include a diverter or other device to run tests or other procedures. After such procedures or tests are completed, riser 92 can be retrieved, or disassembled, using the reversal of steps for assembling riser 92 discussed above.

Tensioner 30 may also be utilized to compensate for offset of a vessel connected to riser 92. For example, tensioner 30 is placed, or disposed, in communication with a vessel and riser 92. Manifold 60 may then be placed in communication with at least one control source to provide tension to cylinders 70.

Additionally, the drilling or production vessel may be stabilized using tensioner 30 of the present invention by maintaining and adjusting tension in tensioning cylinders by maintaining and adjusting the pressure through tensioning cylinders by placing tensioning cylinders in communication with manifold and at least one control source.

It is to be understood that the invention is not limited to the exact details of construction, operation, exact materials, or embodiments shown and described, as obvious modifications and equivalents will be apparent to one skilled in the art. For example, the rod end of the tensioning cylinder may be in communication.with the manifold. Also, the individual sub-assemblies may be manufactured separately and assembled using bolts, welding, or any other device or method known to persons of ordinary skill in the art. Moreover, the individual assemblies may be manufactured out of any material and through any method known to persons of ordinary skill in the art. Additionally, one or more tubulars may be inserted through the tensioner, with the base of the tensioner being secured to at least one of the tubulars prior to connecting one of the tubulars to the riser and lowering the tensioner through the rig floor and into the moonpool. Further, the tensioner having one or more tubulars inserted through the tensioner as described in the previous sentence may be connected to a riser having two or more tubulars assembled prior to connecting the at least one tubular inserted through the tensioner and lowering the tensioner through the rig floor and into the moonpool. Moreover, the flexjoint bearing may be a devise and pin, shackle, or other mechanical joining or lifting device that provides angular movement. Accordingly, the invention is therefore to be limited only by the scope of the claims.

What is claimed is:

1. A tensioner comprising:

at least one mandrel;

at least one upper flexjoint swivel assembly in communication with the at least one mandrel;

at least one manifold in communication with the at least one upper flexjoint swivel assembly, the at least one manifold having a first radial fluid band and a second radial fluid band;

at least one tensioning cylinder having a blind end, a rod end, and at least one transfer tubing, the blind end being in communication with the first radial fluid band, the transfer tubing being in communication with the second radial fluid band and the rod end being in communication with at least one flexjoint bearing; and a base in communication with the at least one flexjoint bearing.

2. The tensioner of claim 1, wherein the manifold includes a third radial fluid band, the third radial fluid band being in communication with either the blind end or the at least one transfer tubing.

3. The tensioner of claim 2, wherein the first and third radial fluid bands are in communication with the at least one transfer tubing and the second radial fluid band is in communication with the blind end of the at least one tensioning cylinder.

4. The tensioner of claim 3, wherein the tensioner includes six tensioning cylinders, wherein at least one of the tensioning cylinders is in communication with a first control source and at least one of the tensioning cylinders is in communication with a second control source.

5. The tensioner of claim 4, wherein the first and second control sources are in communication with the same tensioning cylinder.

6. The tensioner of claim 2, further comprising at least one hang-off donut.

7. The tensioner of claim 2, wherein at least one of the first, second, or third radial fluid bands is in communication with at least one transducer.

8. The tensioner of claim 1, wherein the blind end is connected to the manifold by at least one sub seal.

9. The tensioner of claim 1, wherein each of the at least one tensioning cylinder includes at least one cylinder head.

10. The tensioner of claim 1, wherein the tensioner includes at least two tensioning cylinders.

11. The tensioner of claim 1, further comprising at least one lower flexjoint swivel assembly in communication with the at least one tensioning cylinder and the base.

12. A tensioner comprising:

at least one mandrel having a first mandrel end and a second mandrel end;

at least one upper flexjoint swivel assembly having a first upper flexjoint swivel assembly end and a second upper flexjoint swivel assembly end;

at least one manifold having a first manifold surface and a second manifold surface;

at least one tensioning cylinder having a blind end, a rod end, and at least one flexjoint bearing in communication with the rod end;

and a base, wherein the second mandrel end is connected to the first upper flexjoint swivel assembly end, the second upper flexjoint swivel assembly end is connected to the first manifold surface, the second manifold surface is connected to the blind end, and the rod end and the at least one flexjoint bearing are connected to the base.

13. The tensioner of claim 12, further comprising at least one lower flexjoint swivel assembly having a first lower flexjoint swivel, assembly end and a second lower flexjoint swivel assembly end, wherein the rod end is connected to the first lower flexjoint swivel assembly end and the second lower flexjoint swivel assembly end is connected to the base.

14. The tensioner of claim 12, wherein the at least one tensioning cylinder includes at least one transfer tubing, the at least one transfer tubing being in communication with the manifold.

15. The tensioner of claim 14, wherein, wherein the manifold includes two radial fluid bands in communication with the at least one transfer tubing and one radial fluid band in communication with the blind end of the at least one tensioning cylinder.

16. The tensioner of claim 15, wherein the tensioner includes six tensioning cylinders, wherein at least one of the tensioning cylinders is in communication with a first control source and at least one tensioning cylinder is in communication with a second control source.

17. The tensioner of claim 16, wherein the first and second control sources are in communication with the same tensioning cylinder.

18. The tensioner of claim 12, further comprising at least one hang-off donut.

19. The tensioner of claim 12, wherein the at least one manifold includes at least two radial fluid bands.

20. The tensioner of claim 19, wherein at least one of the at least two radial fluid bands is in communication with the blind end and at least one of the at least two radial fluid bands is in communication with the rod end.

21. A tensioner comprising:

at least one mandrel, at least one upper flexjoint swivel assembly, at least one manifold having at least two radial fluid bands, at least one tensioning cylinder, and a base, the at least one tensioning cylinder includes a blind end in communication wit the at least one manifold and a rod end in communication with the base;

wherein the at least one mandrel, the at least one upper flexjoint swivel assembly, the at least one manifold, the at least one tensioning cylinder, and the base are assembled to form a unitary, co-linear tensioner.

22. The tensioner of claim 21, further comprising at least one lower flexjoint swivel assembly.

23. The tensioner of claim 22, wherein the at least one mandrel is connected to the at least one upper flexjoint swivel assembly, the at least one upper flexjoint swivel assembly is connected to the at least one manifold, the at least one manifold is connected to the at least one tensioning cylinder, the at least one tensioning cylinder is connected to the at least one lower flexjoint swivel assembly, and the at least one lower flexjoint swivel assembly is connected to the base.

24. A method for assembling a riser having a plurality of tubulars comprising the steps of:

(a) providing a tensioner having a first tensioner end, a second tensioner end, a retracted position, an extended position, at least one mandrel, at least one upper flexjoint swivel assembly in communication with the at least one mandrel, at least one manifold in communication with the at least one upper flexjoint swivel assembly, the at least one manifold having a first radial fluid band and a second radial fluid band, at least one tensioning cylinder having a blind end, a rod end, and at least one transfer tubing, the blind end being in communication with the first radial fluid band, the transfer tubing being in communication with the second radial fluid band, and a base in communication with the rod end of each of the at least one tensioning cylinder;

(b) providing a drilling or production facility having a rig floor and a moonpool disposed below the rig floor, the rig floor including at least one rig floor slip having a rig floor slip opened position and a rig floor slip closed position;

(c) inserting the tensioner through the at least one rig floor slip, through the rig floor, and into the moonpool;

(d) connecting the tensioner to the rig floor;

(e) inserting a first tubular through the at least one rig floor slip, through the rig floor, through the tensioner, and into the moonpool;

(f) disposing the at least one rig floor slip around the first tubular and moving the at least one rig floor slip from the rig floor slip opened position to the rig floor slip closed position, whereby the first tubular is maintained in place by the at least one rig floor slip;

(g) connecting a second tubular to the first tubular thereby forming a riser having a plurality of tubulars;

(h) moving the at least one rig floor slip from the rig floor closed position to the rig floor opened position;

(i) inserting the second tubular through the at least one rig floor slip, through the rig floor, through the tensioner, and into the moonpool;

(j) moving the at least one rig floor slip from the rig floor slip opened position to the rig floor slip closed position, whereby the riser is maintained in place by the at least one rig floor slip;

(k) releasably securing the base of the tensioner to the first tubular;

(l) connecting a third tubular to the second tubular;

(m) moving the at least one rig floor slip from the rig floor closed position to the rig floor opened position;

(n) inserting the third tubular through the at least one rig floor slip, through the rig floor, through the tensioner, and into the moonpool, thereby moving the tensioner from the retracted position to the extended position;

(o) moving the at least one rig floor slip from the rig floor slip opened position to the rig floor slip closed position;

(p) releasing the base of the tensioner from the first tubular, whereby the riser is maintained in place by the at least one rig floor slip;

(q) moving the tensioner from the extended position to the retracted position;

(r) releasably securing the base of the tensioner to the second tubular;

(s) connecting a fourth tubular to the third tubular;

(t) moving the at least one rig floor slip from the rig floor closed position to the rig floor opened position;

(u) inserting the fourth tubular through the at least one rig floor slip, through the rig floor, through the tensioner, and into the moonpool, thereby moving the tensioner from the retracted position to the extended position;

(v) moving the at least one rig floor slip from the rig floor slip opened position to the rig floor slip closed position;

(w) releasing the base of the tensioner from the second tubular, whereby the riser is maintained in place by the at least one rig floor slip;

(x) moving the tensioner from the extended position to the retracted position; and (y) releasably securing the base of the tensioner to the third tubular.

25. The method of claim 24, further comprising the step of:

(z) repeating steps (s) through (y) with at least one additional tubular until the riser has a predetermined length.

26. The method of claim 24, further comprising the steps of:

connecting a final tubular to the riser; and inserting the final tubular through the at least one rig floor slip, through the rig floor and the tensioner, and into the moonpool.

27. The method of claim 24, wherein the tensioner is moved from the extended position to the retracted position, by activating at least one control source in communication with the tensioner.

28. The method of claim 24, wherein the tensioner and each of the plurality of tubulars are inserted through the rig floor and into the moonpool by lifting and positioning the tensioner and each of the plurality of tubulars with a crane.

29. The method of claim 24, wherein the tensioner and each of the plurality of tubulars are inserted through the rig floor and into the moonpool by lifting and positioning the tensioner and each of the plurality of tubulars with a jack knife hoisting rig.

30. The method of claim 24, wherein the tensioner is connected to the rig floor by removing the at least one rig floor slip and resting the tensioner on the rig floor.

31. The method of claim 24, wherein the tensioner is connected to the rig floor by placing the tensioner in communication with a rotating bearing disposed on the rig floor.

32. The method of claim 24, wherein at least one spider beam is inserted and at least one subsea appliance is disposed on the at least one spider beam and connected to the first tubular prior to the connection of the second tubular to the first tubular.

33. The method of claim 32, wherein the at least one spider beam is removed after the connection of the at least one subsea appliance is connected to the first tubular.

34. A method for assembling a riser having a plurality of tubulars comprising the steps of:

(a) providing a tensioner having a first tensioner end, a second tensioner end, a retracted position, an extended position, at least one mandrel, at least one upper flexjoint swivel assembly in communication with the at least one mandrel, at least one manifold in communication with the at least one upper flexjoint swivel assembly, the at least one manifold having a first radial fluid band and a second radial fluid band, at least one tensioning cylinder having a blind end, a rod end, and at least one transfer tubing, the blind end being in communication with the first radial fluid band, the transfer tubing being,in communication with the second radial fluid band, and a base in communication with the rod end of each of the at least one tensioning cylinder;

(b) providing a drilling or production facility having a rig floor and a moonpool disposed below the rig floor, the rig floor having at least one rig floor slip having a rig floor slip opened position and a rig floor slip closed position;

(c) inserting a first tubular through the at least one rig floor slip, through the rig floor, and into the moonpool;

(d) moving the at least one rig floor slip from the rig floor slip opened position to the rig floor slip closed position, whereby the first tubular is maintained in place by the at least one rig floor slip;

(e) connecting a second tubular to the first tubular thereby forming a riser having a plurality of tubulars;

(f) moving the at least one rig floor slip from the rig floor closed position to the rig floor opened position;

(g) inserting the second tubular through the at least one rig floor slip, through the rig floor, and into the moonpool;

(h) moving the at least one rig floor slip from the rig floor slip opened position to the rig floor slip closed position, whereby the riser is maintained in place by the at least one rig floor slip;

(i) providing at least one spider beam, the at least one spider beam having at least one spider beam slip having a spider beam slip opened position and a spider beam slip closed position;

(j) disposing the at least one spider beam slip around the riser and moving the at least one spider beam slip from the spider beam slip opened position to the spider beam slip closed position;

(k) moving the at least one rig floor slip from the rig floor slip closed position to the rig floor slip opened position, whereby the riser is maintained in place by the at least one spider beam slip;

(l) lowering the tensioner over the riser, through the rig floor, and into the moonpool, whereby the riser passes through the tensioner;

(m) connecting the tensioner to the rig floor;

(n) releasably securing the base of the tensioner to the riser; and (o) moving the at least one spider beam slip from the spider beam slip opened position to the spider beam slip closed position, whereby the riser is maintained in place by the tensioner.

35. The method of claim 34, further comprising the step of:

(p) after step (h) repeating steps (e) through (h) with at least one additional tubular until the production riser has a predetermined length.

36. The method of claim 35, wherein the riser includes at least 10 tubulars.

37. The method of claim 35, wherein the riser includes at least 50 tubulars.

38. The method of claim 34, wherein the tensioner and each of the plurality of tubulars are inserted through the rig floor and into the moonpool by lifting and positioning the tensioner and each of the plurality of tubulars with a crane.

39. The method of claim 34, wherein the tensioner and each of the plurality of tubulars are inserted through the rig floor and into the moonpool by lifting and positioning the tensioner and each of the plurality of tubulars with a jack knife hoisting rig.

40. The method of claim 34, wherein the tensioner is connected to the rig floor by resting the tensioner on the rig floor.

41. The method of claim 34, wherein the tensioner is connected to the rig floor by placing the tensioner in communication with a rotating bearing disposed on the rig floor.

42. A method for assembling a riser having a plurality of tubulars comprising the steps of:

(a) providing a tensioner having a first tensioner end, a second tensioner end, a retracted position, an extended position, at least one mandrel, at least one upper flexjoint swivel assembly in communication with the at least one mandrel, at least one manifold in communication with the at least one upper flexjoint swivel assembly, the at least one manifold having a first radial fluid band and a second radial fluid band, at least one tensioning cylinder having a blind end, a rod end, and at least one transfer tubing, the blind end being in communication with the first radial fluid band, the transfer tubing being in communication with the second radial fluid band, and a base in communication with the rod end of each of the at least one tensioning cylinder;

(b) providing a drilling or production facility having a rig floor and a moonpool disposed below the rig floor, the rig floor having at least one rig floor slip having a rig floor slip opened position and a rig floor slip closed position;

(c) inserting a first tubular through the at least one rig floor slip, through the rig floor, and into the moonpool;

(d) moving the at least one rig floor slip from the rig floor slip opened position to the rig floor slip closed position, whereby the first tubular is maintained in place by the at least one rig floor slip;

(e) providing at least one spider beam, the at least one spider beam having at least one spider beam slip having a spider beam slip opened position and a spider beam slip closed position;

(f) disposing the at least one spider beam slip around the first tubular and moving the at least one spider beam slip from the spider beam slip opened position to the spider beam slip closed position;

(g) moving the at least one rig floor slip from the rig floor slip closed position to the rig floor slip opened position, whereby the first tubular is maintained in place by the at least one spider beam slip;

(h) lowering the tensioner over the first tubular, through the rig floor, and into the moonpool, whereby the first tubular passes through the tensioner;

(i) connecting the tensioner to the rig floor;

(j) releasably securing the base of the tensioner to the first tubular;

(k) moving the at least one spider beam slip from the spider beam slip closed position to the spider beam slip opened position, whereby the first tubular is maintained in place by the tensioner;

(l) connecting a second tubular to the first tubular thereby forming a riser having a plurality of tubulars;

(m) moving the at least one rig floor slip from the rig floor closed position to the rig floor opened position;

(n) inserting the second tubular through the at least one rig floor slip, through the rig floor, through the tensioner, and into the moonpool, thereby moving the tensioner from the retracted position to the extended position;

(o) moving the at least one rig floor slip from the rig floor slip opened position to the rig floor slip closed position;

(p) releasing the base of the tensioner from the riser, whereby the riser is maintained in place by the at least one rig floor slip;

(q) moving the tensioner from the extended position to the retracted position; and (r) releasably securing the base of the tensioner to the riser.

43. The method of claim 42, further comprising the step of:

(s) repeating steps (l) through (r) with at least one additional tubular until the riser has a predetermined length.

44. The method of claim 42, wherein the second tubular is connected to the first tubular to form the riser having a plurality of tubulars prior to step (h).

45. The method of claim 42, wherein at least two additional tubulars are connected to the riser prior to step (h) by:

moving the at least one rig floor slip from the rig floor closed position to the rig floor opened position;

connecting the at least one additional tubular to the riser;

inserting the at least one additional tubular through the at least one rig floor slip, through the rig floor, and into the moonpool;

moving the at least one rig floor slip from the rig floor slip opened position to the rig floor slip closed position, whereby the riser is maintained in place by the at least one rig floor slip;

repeating the above steps with at least one additional tubular until the production riser has a predetermined length.

46. The method of claim 42, further comprising the step of:

removing the at least one spider beam after step (k).

47. The method of claim 42 further comprising the steps of:

connecting a final tubular to the production riser; and inserting the final tubular through the at least one rig floor slip, through the rig floor, and into the moonpool.

* * * * *